US005564902A

United States Patent [19]

Tomita

[11] Patent Number: 5,564,902

[45] Date of Patent: Oct. 15, 1996

[54] GAS TURBINE ROTOR BLADE TIP COOLING DEVICE

[75] Inventor: Yasuoki Tomita, Takasago, Japan

[73] Assignee: Mitsubishi Jukogyo Kabushiki Kaisha, Tokyo, Japan

[21] Appl. No.: 426,187

[22] Filed: Apr. 21, 1995

[30] Foreign Application Priority Data

Apr. 21, 1994 [JP] Japan ..... 6-082925

[51] Int. Cl.[6] ..... F01D 5/18; F01D 5/20

[52] U.S. Cl. ..... 416/97 R; 416/92; 415/115; 415/173.1; 415/173.4

[58] Field of Search ..... 415/115, 173.1, 415/173.4, 173.5, 173.6; 416/92, 96 R, 96 A, 97 R, 97 A

[56] References Cited

U.S. PATENT DOCUMENTS

| | | | |
|---|---|---|---|
| 3,635,585 | 1/1972 | Metzler, Jr. | 416/92 |
| 3,885,886 | 5/1975 | Richter . | |
| 3,899,267 | 8/1975 | Dennis et al. | 416/92 |
| 4,142,824 | 3/1979 | Andersen . | |
| 4,384,823 | 5/1983 | Graham et al. | 416/97 R |
| 4,390,320 | 6/1983 | Eiswerth | 416/92 |
| 4,487,550 | 12/1984 | Horvath et al. . | |
| 4,540,339 | 9/1985 | Horvath . | |
| 4,589,823 | 5/1986 | Koffel | 416/92 |
| 4,802,828 | 2/1989 | Rutz et al. | 415/173.4 |
| 4,874,290 | 10/1989 | Cang et al. | 415/173.4 |
| 5,193,975 | 3/1993 | Bird et al. | 415/115 |

FOREIGN PATENT DOCUMENTS

| | | | |
|---|---|---|---|
| 62-223402 | 10/1987 | Japan | 416/96 R |
| 1164847 | 9/1969 | United Kingdom . | |
| 2075129 | 11/1981 | United Kingdom . | |
| 2158160 | 11/1985 | United Kingdom . | |
| 2162201 | 1/1986 | United Kingdom . | |
| 2184492 | 6/1987 | United Kingdom . | |

*Primary Examiner*—Edward K. Look
*Assistant Examiner*—Christopher Verdier
*Attorney, Agent, or Firm*—Timothy N. Trop

[57] ABSTRACT

In a gas turbine hollow cooled rotor blade, a plurality of cooling holes 3 and 5 are provided which communicate between a cooling air passage in the blade and the tip squealer portion 1 on the pressure side and between the cooling air passage in the blade and a position in the vicinity of the suction side of a tip cap 4.

3 Claims, 5 Drawing Sheets

GAS TURBINE ROTOR BLADE TIP COOLING DEVICE

FIELD OF THE INVENTION AND RELATED ART STATEMENT

The present invention relates to a cooling device for a gas turbine hollow rotor blade tip portion.

FIG. 9 is a perspective view showing one example of a conventional gas turbine hollow rotor blade. In the figure, the cooling air (supplied by a compressor) flowing into a blade from the bottom of a blade root 11 flows in the arrow-marked direction to cool the rotor blade. Specifically, the cooling air, flowing into the blade from tile leading edge side 12A flows through a winding passage having fins 13 to cool the blade, flows out of the blade through a hole A in the blade top at which a tip squealer (thinning) 14 is provided, and joins with the main gas flow which rotates the turbine. The cooling air, flowing into the blade from the trailing edge side 12B, flows through a cooling passage provided with fins 13 in the arrow-marked direction, cools the blade trailing edge by means of pin fins 15, flows out of the blade through holes or slits B, and joins with the main gas flow.

FIG. 10 is a plan view of the rotor blade tip. The tip squealer 14 is formed in a thin wall shape along the blade profile to avoid contact with a circular ring of casing.

In a high-temperature gas turbine as described above, the gas turbine rotor blade must withstand high temperatures. Especially at the blade tip portion, the tip squealer 14 is provided to protect the blade from damage caused by the contact with a ring segment.

However, the tip squealer 14 serves as a heat transfer fin at the same time. Therefore, the temperature of the tip squealer 14 is increased greatly by receiving heat from high-temperature gas which rotates tile turbine, which often results in high-temperature oxidation.

Also, the lower face of a tip cap at the trailing edge portion is usually formed thicker than other portions because the blade thickness is small. The thicker the tip cap is, the higher the temperature is.

SUMMARY OF THE INVENTION

The present invention was made to solve the above problems. Accordingly, an object of the present invention is to provide a gas turbine rotor blade tip cooling device in which the high-temperature oxidation of the tip portion caused by abnormally increased temperature is prevented, and the reliability can be improved without adverse effects on the aerodynamic characteristics of the blade.

To achieve the above object, the present invention provides a gas turbine rotor blade tip cooling device having a plurality of cooling holes communicating between a cooling air passage in the blade and the outside surface of a tip squealer portion on the pressure side and a plurality of cooling holes communicating between the cooling air passage in the blade and the tip cap surface in the vicinity of the inner surface of a tip squealer portion on the suction side, which are formed in a gas turbine hollow cooled rotor blade.

Further, the gas turbine hollow cooled rotor blade of the present invention is characterized in that the tip squealer portion is formed low (0.1 mm to 5.0 mm).

Still further, the gas turbine hollow cooled rotor blade of the present invention is characterized in that cooling holes are provided at a tip squealer portion in the range from the leading edge on the pressure side to the intermediate position at the trailing edge portion on the pressure side and at a portion at which the tip squealer portion on the pressure side of a tip cap is lacking, and the thickness of the tip cap at the portion at which the tip squealer portion on the pressure side of the tip cap is lacking is nearly the same as the thickness of the tip cap at other portions.

Since the high-temperature gas at the rotor blade tip flows through the clearance between the tip and a ring segment from the pressure side to the suction side, the tip squealer portion on the pressure side is film cooled by forming cooling holes at the tip squealer on the pressure side and at a position in the vicinity of the suction side of a tip cap. The cooling holes in the vicinity of the suction side of the tip cap contribute to convection cooling, providing effective tip cooling.

According to the present invention, the tip squealers provided on the pressure side and on the suction side are film cooled, so that the temperature of tip does not become so abnormally high as to cause high-temperature oxidation.

The flow at the turbine tip clearance is produced from the pressure side 40 to the suction side 41 by the difference in pressure between the pressure side 40 and the suction side 41 of the tip (FIG. 4). In the conventional tip, this flow is produced as shown in FIG. 5*a*. In the present invention, as shown in FIG. 5*b*, the tip squealers 42 and 43, which are hot, are covered by a cooling air film of the flow indicated by the arrow in the figure, by which the turbine can be protected from high-temperature gas. Also, the cooling holes 5 at the tip squealer on the pressure side are provided in the oblique direction from the interior of blade. Therefore, the cooling air passing through these holes can join with the flow at the tip clearance smoothly. The length of the cooling hole is large as compared with a cooling hole 51 shown in FIG. 6, which was disclosed in U.S. Pat. No. 5,261,789, so that the heat exchange, from the inside surface of cooling hole provides excellent cooling property.

The improvement in the present invention does not change the tip profile, so that the hydrodynamic characteristics are not affected.

Since the tip squealer height is lower, the tip squealer at trailing edge portion Y on the pressure side is lacking. Cooling holes are provided at this portion, and the thickness of tip cap at this portion is nearly the same as that of tip cap at other portions. Thus, the high temperatures created in the conventional rotor blade, caused by high tip squealer and thick tip cap, can be avoided.

Conventionally, the height h' (FIG. 7) of tip squealer portions 1 and 2 has been large, so that the heat input from the gas side has been high. In the present invention, the height (h in FIG. 8) is small, so that the heat input from the gas side can be decreased.

The applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF PREFERRED EMBODIMENTS

Figure 1:
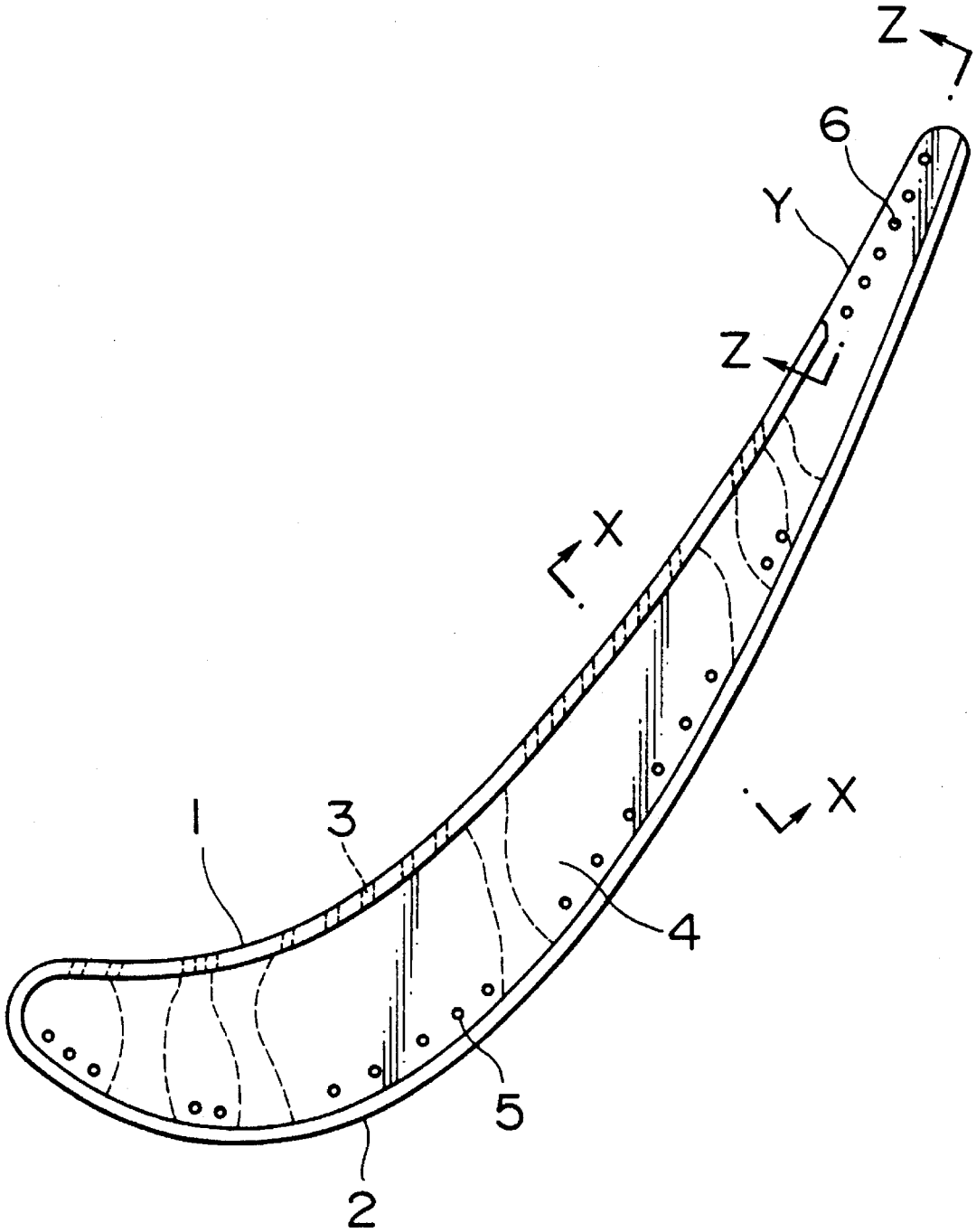
FIG. 1 is a plan view of a tip cooled rotor blade in accordance with one embodiment of the present invention.

An embodiment of the present invention will be described below with reference to the drawings. In FIG. 1, a tip squealer I on the pressure side of a rotor blade and a tip squealer 2 on the suction side are provided along the plan shape of the blade. These tip squealers 1 and 2 have heights lower than those of the conventional rotor blade, the height (h) thereof being 0.1 mm to 5.0 mm.

Therefore, a tip squealer of a height (h) of about 5.0 mm is usually provided in a thin wall shape along the blade profile to provide measures against the contact with a circular ring of casing. In the embodiment of the present invention, the height of tip squealer 1, 2 from a tip cap (h in FIG. 2) is as small as 0.1 mm to 5.0 mm, preferably 0.1 mm to 1.5 mm, by which the portion serving as a heat transfer fin receiving heat from high-temperature gas can be decreased while avoiding contact with the circular ring of casing, so that the increase in temperature of rotor blade can be prevented. If the height h is less than 0.1 mm, the manufacturing error cannot be accommodated. The tip squealer 1 on the pressure side is provided with cooling holes 3 as shown in FIG. 2, which is a sectional view taken along the line X—X of FIG. 1.

Figure 2:
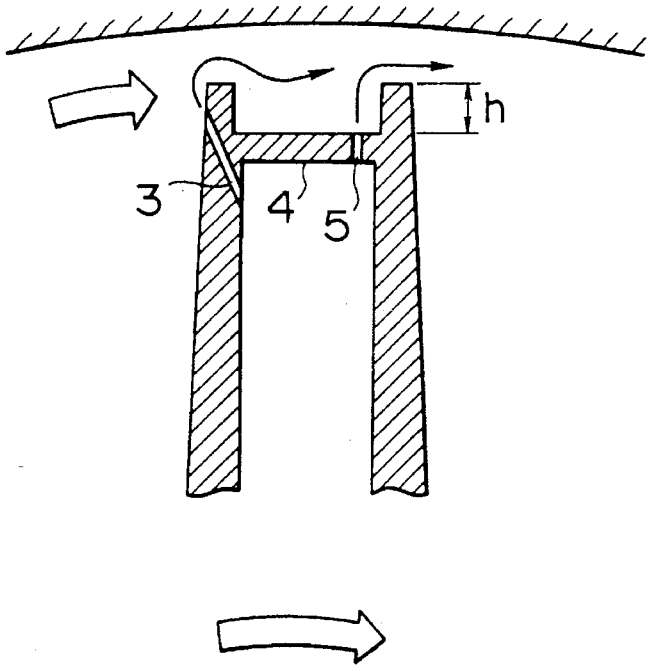
FIG. 2 is a sectional view taken along the line X—X of FIG. 1.

In the vicinity of the suction side of the tip cap 4, cooling holes 5 are made as shown in FIGS. 1 and 2. The diameter of the cooling hole 3, 5 is about 0.5 mm to 2.0 mm. If the diameter is less than 0.5 mm, the hole is clogged with dust, so that the diameter from 0.1 mm to 2.0 mm is effective in terms of heat transfer and thermal stress. If the diameter exceeds 2.0 mm, damage may be caused by drilling.

Figure 3:
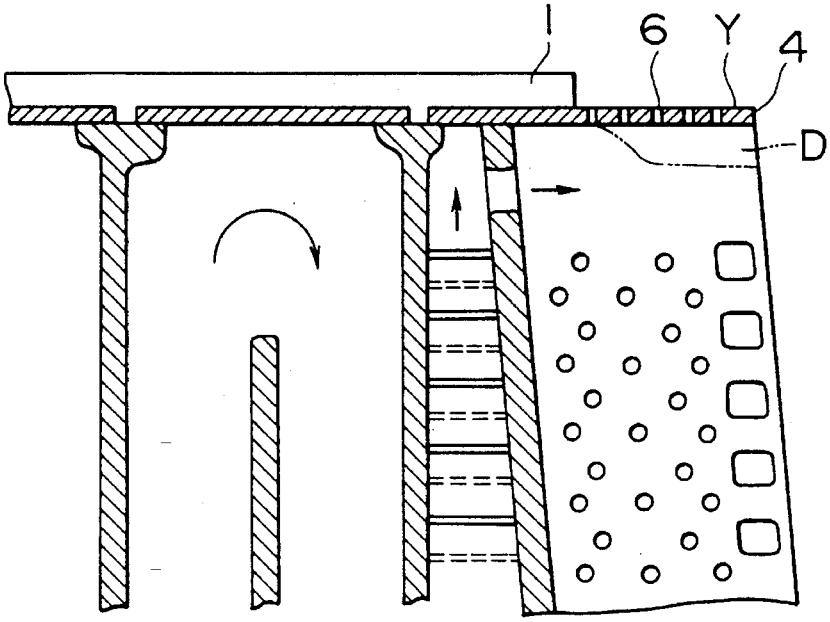
FIG. 3 is a sectional view taken along the line Z—Z of FIG. 1.
Figure 4:
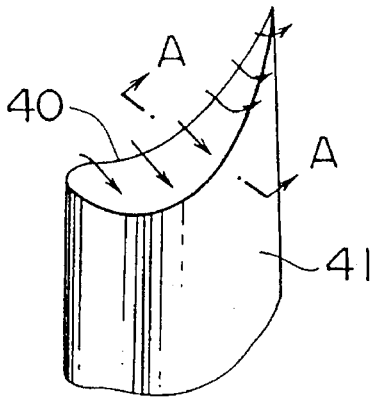
FIG. 4 is a perspective view schematically showing the upper part of a tip cooled rotor blade to which the present invention is applied.
Figure 5A:
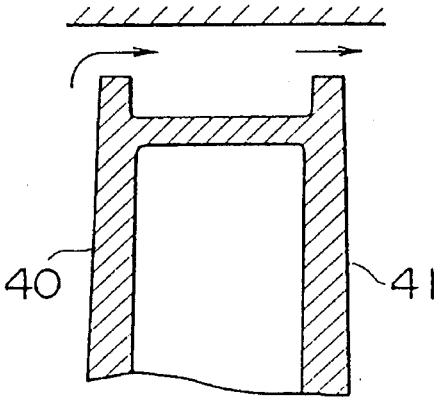
FIG. 5a PRIOR ART
FIG. 5*a* is a schematic sectional view showing a tip cooled rotor blade having no cooling hole 5 and FIG. 5*b* shows a tip cooled blade having a cooling hole 5.
Figure 5B:
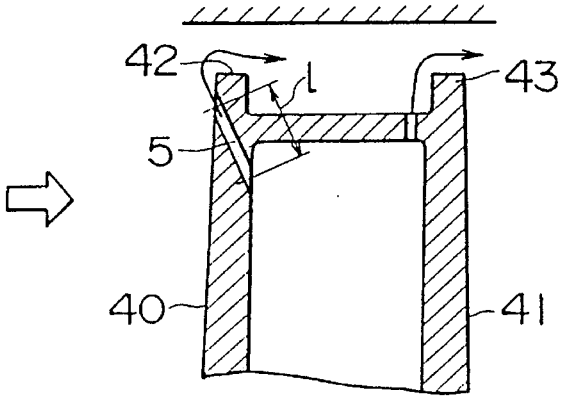
Figure 6:
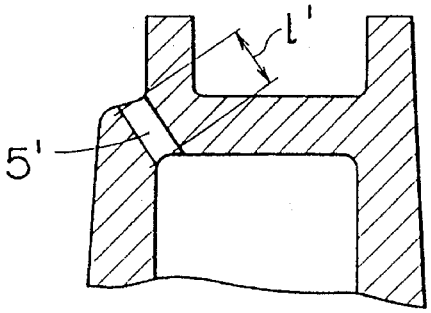
FIG. 6 PRIOR ART
FIG. 6 is a schematic sectional view showing a tip cooled rotor blade of U.S. Pat. No. 5,261,789.
Figure 7:
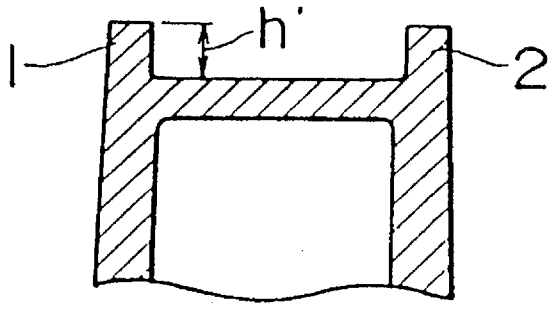
FIG. 7 PRIOR ART
FIG. 7 is a schematic sectional view showing a tip squealer of a conventional tip cooled rotor blade.
Figure 8:
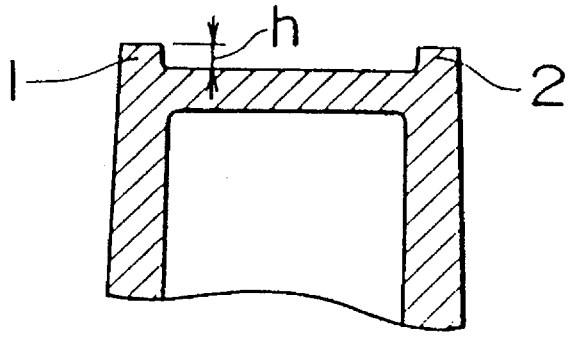
FIG. 8 is a schematic sectional view showing a tip squealer of a tip cooled rotor blade in accordance with the present invention.
Figure 9:
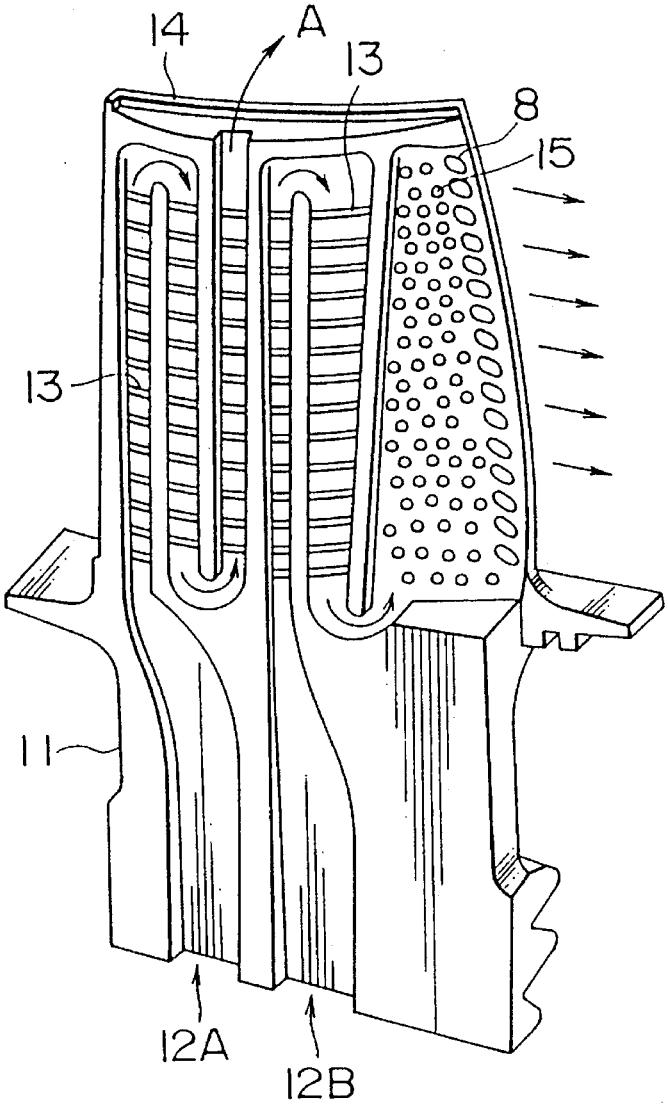
FIG. 9 PRIOR ART
FIG. 9 is a perspective sectional view showing one example of a conventional hollow cooled rotor blade.
Figure 10:
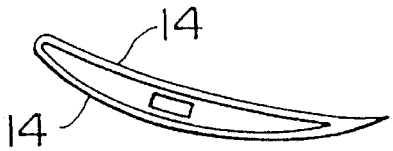
FIG. 10 PRIOR ART
FIG. 10 is a plan view of the hollow cooled rotor blade shown in FIG. 9.

In the rotor blade having such a cooling configuration, at the trailing edge portion on the pressure side, which is relatively less affected by the contact with the circular ring of casing, the tip squealer 1 on the pressure side is lacking as shown by portion Y in FIG. 1. At this portion, cooling holes 6 are made toward the tip direction of rotor blade. At portion Y, at which the tip squealer on the pressure side is lacking, the thickness of the tip cap 4 is nearly the same as that of the tip cap at other portions as shown in FIG. 3, which is a sectional view taken along the line Z—Z of FIG. 1. Therefore, the trailing edge portion of the rotor blade does not form a sharp end portion, at which the blade thickness is thin, of the trailing edge portion of the conventional rotor blade.

Virtual line portion D shows the thick shape of the tip cap at the trailing edge portion of the conventional rotor blade. Because the tip squealer is lacking at this portion, the portion serving as a heat transfer fin which receives heat from high-temperature gas is small. Also, because the tip cap has a uniform thickness, not only the temperature of this portion does not increase but the increase in temperature of rotor blade can effectively be prevented by a synergistic effect with the cooling air flowing through the cooling holes 6 provided at this portion.

As described in detail above, according to the tip cooling device for gas turbine rotor blade in accordance with the present invention, the function of tip squealer as a heat transfer fin can be augmented by the cooling air flowing through the cooling holes provided at this portion, so that the temperature of the tip portion does not become abnormally high, alleviating the cause of high-temperature oxidation.

The cooling holes in the tip squealer on the pressure side, which are provided in the oblique direction from the interior of blade, do not change the shape of tip squealer provided along the blade profile. Therefore, the aerodynamic characteristics of blade are not affected, so that effective cooling can be effected.

Also, the temperature increasing phenomenon due to the presence of thick portion of tip cap, which is found in the conventional rotor blade, can be avoided, so that the effect of contributing to the improved reliability of gas turbine is very great due to the synergistic effect with the cooling performed by the cooling holes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A cooled gas turbine rotor blade having a leading edge, a trailing edge portion, a pressure side, and a suction side, said blade comprising a cooling air passage in the blade, a tip squealer portion having an outside surface, a first portion of said blade on said pressure side having no tip squealer portion, a plurality of cooling holes communicating between said cooling air passage in the blade and the outside surface of said tip squealer portion, said cooling holes being located in the region from said leading edge on the pressure side to the intermediate position at the trailing edge portion on the pressure side and a plurality of cooling holes communicating between said cooling air passage in the blade and said first portion of said blade.

2. A gas turbine rotor blade according to claim 1, said blade including a tip cap, wherein the thickness of said tip cap at the portion at said first portion is nearly the same as the thickness of said tip cap at other portions.

3. A gas turbine rotor blade according to claims 1, or 2, wherein said blade includes a tip cap and further has a plurality of cooling holes communicating between said cooling air passage in the blade and the tip cap in the vicinity of the inner surface of a tip squealer portion on the suction side.

* * * * *